United States Patent [19]

Morane et al.

[11] 3,946,911

[45] Mar. 30, 1976

[54] CAP FOR OPERATING DISPENSING VALVE WHICH MAY BE ACTUATED FROM A PLURALITY OF DIRECTIONS

[75] Inventors: Bruno P. Morane, Paris, France; Giuseppe Sigaudo, Turin, Italy

[73] Assignee: L'Oreal, Paris, France

[22] Filed: May 28, 1975

[21] Appl. No.: 581,677

Related U.S. Application Data

[63] Continuation of Ser. No. 435,586, Jan. 22, 1974.

[30] Foreign Application Priority Data

Mar. 16, 1973 France ..... 73.09585

[52] U.S. Cl. ..... 222/402.11; 222/402.13

[51] Int. Cl.[2] ..... B65D 83/14

[58] Field of Search ..... 222/153, 182, 213, 402.11, 222/402.13, 402.14, 402.15

[56] References Cited

UNITED STATES PATENTS

| | | | |
|---|---|---|---|
| 2,994,461 | 8/1961 | Michel | 222/153 |
| 3,180,532 | 4/1965 | Michel | 222/182 |
| 3,263,868 | 8/1966 | Sagarin | 222/182 |
| 3,404,814 | 10/1968 | Wakeman | 222/402.13 |
| 3,739,941 | 6/1973 | Ostrowsky et al. | 222/402.13 X |
| 3,760,988 | 9/1973 | Ostrowsky | 222/402.11 X |

*Primary Examiner*—Robert B. Reeves
*Assistant Examiner*—Francis J. Bartuska
*Attorney, Agent, or Firm*—Brisebois & Kruger

[57] ABSTRACT

Cap for actuating the valve of a pressurized container comprises an annular group of radially disposed fins hinged at one edge and so positioned that inward pressure on any fin will swing that fin and thereby actuate the valve.

17 Claims, 10 Drawing Figures

CAP FOR OPERATING DISPENSING VALVE WHICH MAY BE ACTUATED FROM A PLURALITY OF DIRECTIONS

This is a continuation of application Ser. No. 435,586, filed Jan. 22, 1974.

SUMMARY OF THE INVENTION

In order to dispense a product stored in a pressurized container closed by a valve, it is conventional to use a push-button for opening and closing the container valve. These push-buttons, when directly actuated by the user, are capable of applying forces to the valve which are not in the same direction as the axis along which the moving part of the valve slides, and damage to the valve may therefore result. Moreover, these push-buttons are generally relatively unattractive.

It has already been suggested that a dispensing cap be associated with the push-button of a container of the aerosol bomb type. This cap covers the head of the container and the push-button and moves the push-button in the desired direction regardless of the direction in which the finger of the user presses on the movable part of the cap. Such caps have, for some people at least, a satisfactory aesthetic appearance, but their movable part can be moved by the user only in a certain direction and, in any case, any pressure by the user on parts of the cap other than the movable part will not result in opening of the dispensing valve. This means that the container must first be properly oriented in the hand of the user in order to permit dispensing.

It is the object of the present invention to provide a dispensing cap which may be associated with a push-button, or which may itself serve as a push-button, said cap being adapted to be actuated by the user without previous orientation of the container with respect to the hand of the user. It is accordingly an object of the present invention to provide, as a new article of manufacture, a dispensing cap adapted to be associated with a pressurized container of the aerosol bomb type, which container comprises a dispensing valve at its upper end, while said cap comprises a peripheral member which carries at one end means for attaching the cap to the pressurized container. The cap is characterized by the fact that it comprises, at the other end of the said peripheral member, a plurality of fins with the plane of each fin passing substantially through the axis of the cap. These fins define an inner space which opens away from the valve and are elastically pivoted with respect to the part of the peripheral member which carries the attaching means. The invention also comprises dispensing means, one end of which fits on the output duct of the container valve with which the cap cooperates and which is positioned at least partially within the inner space defined by the fins of the peripheral member. This dispensing means comprises an annular zone mechanically contacting each of the fins of the peripheral member.

In a first embodiment, the dispensing means comprises a member independent of the peripheral member, and the zone contacted by the fins consists of a small collar on which the fins of the peripheral member bear. In a second embodiment the dispensing member is integral with the fins of the peripheral member and the zone in which said fins contact the dispensing member consists of the zone connecting the fins to the dispensing member.

In a preferred embodiment of the invention the dispensing cap according to the invention is symmetrical about a central axis; the fins of the peripheral member are radial fins separated from each other by substantially radial slots, and the inner space defined by the fins is substantially frusto-conical in shape. The zone of the peripheral member not constituted by the fins comprises a cylindrical wall, at one end of which is positioned means for attaching it to the container. The container on which the dispensing cap fits comprises an annular groove and the cylindrical wall of the peripheral member comprises near its end at least one ridge which snaps into the groove in the container. The annular groove in the container is formed in the lateral cylindrical wall of the container. The peripheral member of the cap is made of a plastic material and the zone connecting the fins to the cylindrical wall of the peripheral member is thick enough to supply the elastic return force acting on each of the fins. The dispensing member comprises at one end a diaphragm and at its other end a spigot adapted to fit over the outlet tube of the valve, the diaphragm and the spigot being connected by an internal duct within the dispensing member.

In a first embodiment the dispensing member is straight. In a second embodiment the dispensing member comprises an elbow and a part of the dispensing member which is perpendicular to the axis of the cap opens outside the cap either below the upper ends of the fins on the peripheral member, or above these ends. In the first case at least one of the fins of the dispensing cap has a recess in its free upper end in order to permit the passage of the portion of the dispensing member which is perpendicular to the axis of the cap. In the second case the dispensing member may advantageously comprise an axial part fitting onto the outlet tube of the valve and a flat part perpendicular to said axial part. This flat part surmounts the fins of the peripheral member and contains the part of the internal duct of the dispensing member which is perpendicular to the axis of the cap.

In an advantageous embodiment of the invention the peripheral member may have a generally cylindrical external shape. The outer edges of the fins constitute generatrices of the cylinder and are positioned in alignment with the cylindrical wall which carries at its free end the means for attaching the cap. The fins of the peripheral member may, however, have a special shape designed to produce an aesthetic effect and, in particular, the assembly of fins may define an external volume which is substantially spherical and which is connected to the cylindrical wall which carries at its lower end the means for attaching the cap to the container.

Finally, it should be noted that the dispensing cap according to the invention may be provided with safety means for preventing the opening of the valve accidentally in the course of transport or handling of a container equipped with the dispensing cap according to the invention. For this purpose there is positioned over the top of the fins of the peripheral member a flat plate comprising as many blocking means as the peripheral member comprises fins. The blocking means may consist either of pins projecting into each of the fins, or projections inserted between each of the fins of the peripheral member. In this way, the safety means locks all the fins with respect to the others and prevents any pivotal movement about the zone about which they are hinged. It is clear that, if the dispensing member projects above the end plane of the blades of the peripheral member, the flat plate which constitutes the safety means must comprise a recess for permitting the passage of the dispensing member therethrough. It is also obvious that the above safety device cannot be used when the dispensing cap according to the invention has a dispensing member comprising a right angle elbow and consisting of an axial part associated with a flat plate surmounting the assembly of fins of the peripheral member.

The safety device which may be associated with the dispensing cap according to the invention may be converted into a device for insuring inviolability by connecting the safety member to the mounting ring fixed to the cap and/or the container. The connection may be made by means of tabs which may or may not be frangible. The member insuring inviolability is then removed by rupturing the tabs holding the plate, which constitutes the safety means, or by breaking a ring connected to said tabs and held on the cap and/or on the container.

One of the essential characteristics of the dispensing cap according to the invention is that it does not comprise any handle projecting beyond the geometrical envelope of the container. In effect, when the dispensing cap according to the invention is externally cylindrical, it is in alignment with a cylindrical container which constitutes the aerosol bomb and no handle projects laterally. This constitutes an advantage during transport of the containers because more containers may be packed inside the same package while being more firmly held therein. When the user desires to operate a pressurized container comprising a cap according to the invention, he holds the container by its dispensing cap and, with one or more fingers, presses transversely on at least one of the fins of the dispensing cap. This pressure swings the fins in question about the zone at which they are hinged and, consequently, causes translation of the dispensing member and depression of the outlet tube of the valve. It follows that dispensing results whenever the user presses a finger on at least one of the fins of the dispensing cap. When the pressure of the fingers is removed, the fins return to their initial position due to elastic recovery, that is to say, to the position in which they do not cause depression of the dispensing member in the direction of the valve. If the dispensing member is straight, the ejection of the product is along the axis of the dispensing cap. If, on the contrary, the dispensing member is elbow-shaped, the ejection of the product to be dispensed takes place radially and, of course, the user must at this time direct the jet of product obtained in the direction in which it is desired to use it.

It is a further object of the present invention to provide, as a new article of manufacture, a pressurized container of the aerosol bomb type, which container comprises a dispensing valve which cooperates with a dispensing cap as herein before described. In order that the object of the invention may be better understood, several embodiments thereof will now be described, purely by way of illustration and example, with reference to the accompanying drawings in which.

Figure 1:
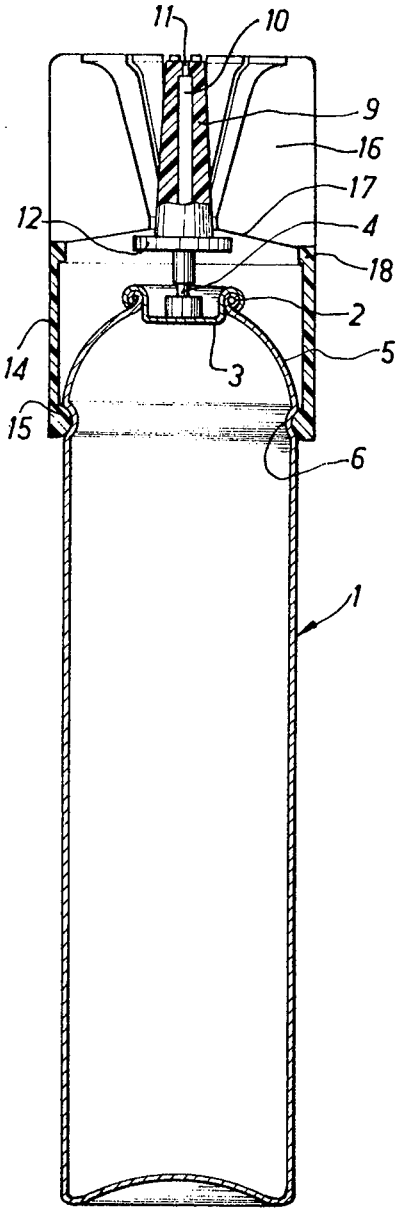
FIG. 1 is an axial sectional view taken through a pressurized container equipped with a cylindrical cap according to the invention.
Figure 2:
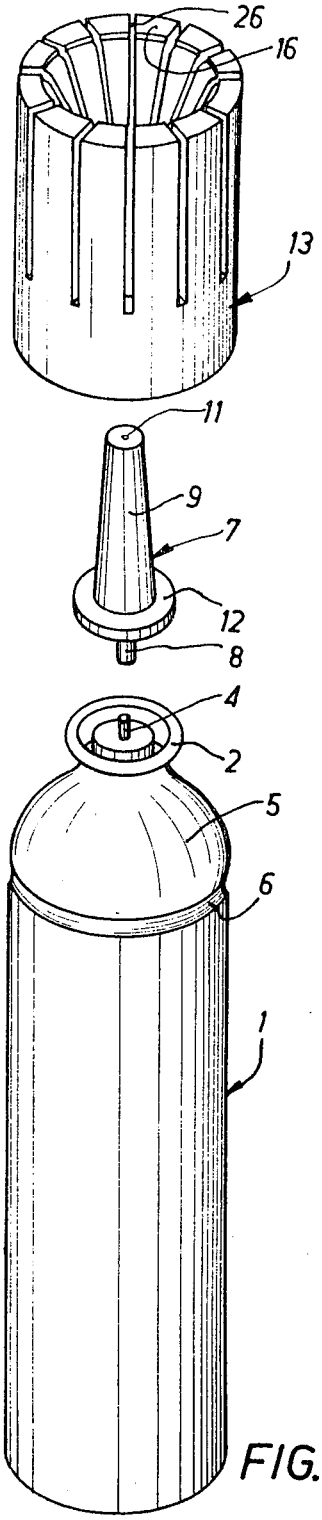
FIG. 2 is an exploded perspective view of the peripheral member, the dispensing member, and the pressurized container of the assembly illustrated in FIG. 1.

Referring now to the drawing, and more particularly to FIGS. 1 and 2, it will be seen that reference numeral 1 indicates a container of the aerosol type on which the display cap according to the invention is mounted. The container 1 is a one-piece can of a conventional type having a domed upper end to which a valve cup 3 is crimped. The corresponding valve comprises an outlet tube 4. The container 1 has a generally cylindrical shape and comprises, where its cylindrical sides meet the domed end 5, an annular groove 6 formed by rolling in a known manner.

A dispensing member 7 is mounted on the outlet tube 4 of the valve of the container 1. The member 7 comprises a spigot 8 adapted to fit onto the outlet tube 4 and a frusto-conical part 9 inside which a dispensing duct 10 is located. At the end of the frusto-conical part 9 is a dispensing disphragm 11 which makes it possible to produce, in a conventional manner, either a spray or a filiform jet. At the base of the frusto-conical part 9 the dispensing member 7 carries a collar 11 which projects from the frusto-conical part 9.

The dispensing cap according to the invention also comprises a peripheral member 13. The peripheral member 13 carries at its lower end a cylindrical wall 14, the lower edge of which carries an annular ridge 15. Above the cylindrical wall 14 the peripheral member 13 comprises a set of fins 16, each separated from the other by radial slots 26. The outer edge of the fins 16 defines a cylindrical surface positioned in alignment with the surface of the cylindrical wall 14. The fins 16 define a frusto-conical internal space the larger end of which is positioned in the plane of the upper ends of the fins 16. Inside this frusto-conical space is mounted the frusto-conical part 9 of the dispensing member 7. The fins 16 are bounded at their lower end by an edge 17 the part of which nearest the axis of the peripheral member 13 is adjacent and directly above the collar 12 of the dispensing member 7. The fins 16 are connected to the cylindrical wall 14 by a connecting ring 18 and may swing elastically about the resilient wall 14. Their hinge consists of a fraction of the ring 18 which permits rotation of each fin 16 in the direction of the axis of the peripheral member 13.

The dispensing member 7 is adapted to fit by its spigot 8 onto the outlet tube 4 of the valve of the container 1. The peripheral member 13 is then positioned on the upper part of the container 1 by forcing the annular ridge 15 into the annular groove 6. At this moment the edges 17 of the fins 16 are in alignment with the collar 12 of the dispensing member 7. If the user wants to dispense the product, he presses with one of his fingers on the outer edge of any one of the fins 16. This fin swings elastically about its hinge zone 18 and the edge 17 presses against the collar 12 thus causing depression of the outlet tube 4 and opening of the valve of the pressurized container 1. The product then flows out through the duct 10 and the diaphragm 11. It will be seen that it is unnecessary for the user to locate the container with respect to his hand in order to obtain a dispensing action, since the action of the fingers may be applied to any one of the fins 16. This characteristic may be especially important when the container according to the invention is used to dispense products intended to treat the hair, for example, dyeing and bleaching products.

Figure 3:
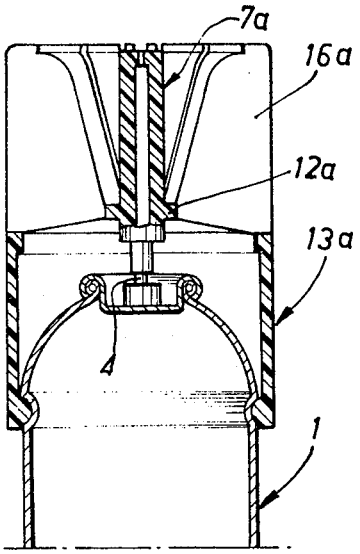
FIG. 3 is an axial sectional view taken through another embodiment of the dispensing cap according to the invention.

FIG. 3 shows another embodiment of the device shown in FIGS. 1 and 2. In this embodiment the container 1 is identical to the one previously described, but the dispensing cap consists of a single piece, that is to say, the peripheral member is integral with the dispensing member.

The peripheral member 13*a* is connected to the dispensing member 7*a* at the level of the collar 12*a* which encircles the lower part of the dispensing member 7*a*. This collar 12*a* is integral with each of the fins 16*a* of the peripheral member 13*a*, but all the other constructional characteristics of the fins 16 and 16*a* are identical. In other words, the structure of the peripheral member 13*a* is identical to the structure of the peripheral member 13 except that each of the fins 16*a* is connected, at its lower end, to the collar 12*a* of the dispensing member 7*a*.

The operation of the dispensing cap illustrated in FIG. 3 is analogous to that of the cap illustrated in FIGS. 1 and 2. It suffices for the user to press on any one of the fins 16*a* to depress the dispensing member 7*a* and consequently depress the outlet tube 4 to which the dispensing member 7*a* is fitted. The advantage of this embodiment resides in the fact that the dispensing cap, since it is made in a single piece, may be mounted more easily on the top of the pressurized container 1.

Figure 4:
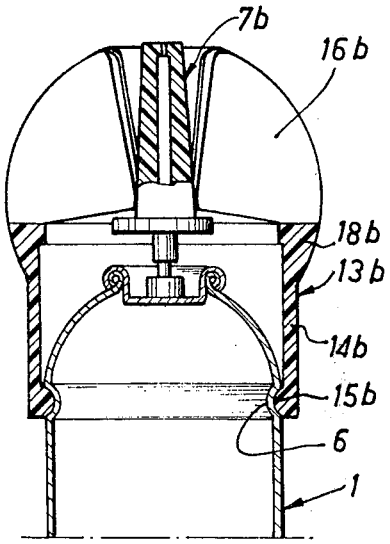
FIG. 4 is an axial sectional view taken through a third embodiment of the dispensing cap according to the invention.

FIG. 4 represents a third embodiment of the device according to the invention. In this embodiment the cap comprises a peripheral member 13*b* and a dispensing member 7*b* constituting two separate pieces. The peripheral member 13*b* has at its lower end a cylindrical wall 14*b* mounted on the container 1 by cooperation between a ridge 15*b* and an annular groove 6 in the container 1. Above the cylindrical wall 14*b* is an annular reinforcing zone 18*b* which connects the radial fins 16*b* with the part 14*b*. These fins constitute the upper part of the peripheral member 13*b*. The fins 16*b* define an internal frusto-conical space identical to the one which has been described in connection with the embodiment of FIG. 1 but their external shape is such that the upper part of the peripheral member 13 defines a substantially spherical volume. The other characteristics of this embodiment are the same as those described in connection with the embodiments of FIGS. 1 and 2. The shape adopted for the fins 16*b* makes it possible to obtain the benefit of an attractive aesthetic appearance for the dispensing cap.

Figure 5:
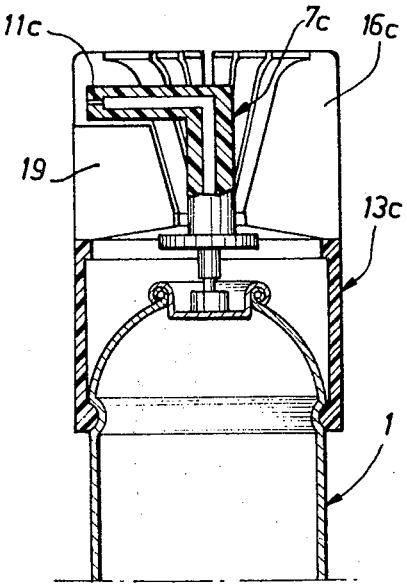
FIG. 5 is an axial sectional view taken through a fourth embodiment of the dispensing cap according to the invention.

FIG. 5 shows another embodiment of the dispensing cap according to the invention. In this embodiment the dispensing member 7*c* is no longer straight, as in the case of the embodiment of FIGS. 1 and 2, but is elbow-shaped so as to dispense the product in a direction perpendicular to the axis of the cap and the container 1 to which it is attached. In order to admit the radial part of the dispensing member 7*c*, one of the fins 16*c* constituting the peripheral member 13*c* of this embodiment is cut off at mid-height. This fin has been indicated by reference numeral 19. Except for this difference, the peripheral member 13*c* is identical to the peripheral member 13 described in connection with FIGS. 1 and 2 and the operation of this embodiment of the dispensing cap according to the invention is also identical to the operation which has heretofore been described, except that the user must, of course, avoid placing his finger over the fin 19 in the trajectory of the dispensing jet which is ejected by the diaphragm 11*c* of the member 7*c*, when dispensing the product.

Figure 6:
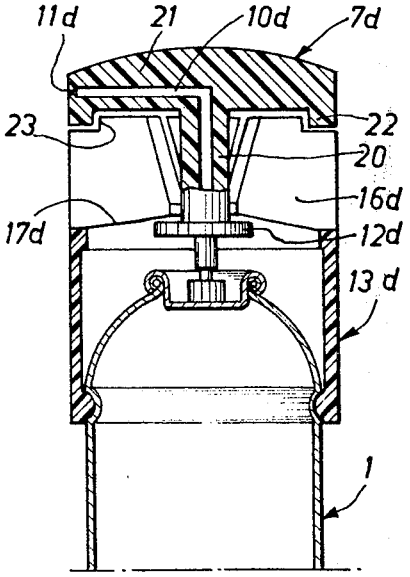
FIG. 6 is an axial sectional view taken through a fifth embodiment of the dispensing cap according to the invention.

FIG. 6 represents a fifth embodiment in which the dispensing member comprises, as in the case of FIG. 5, a dispensing duct 10*d* at a right angle to the axis of the container. In this embodiment the dispensing member 7*d* comprises an axial tube 20 and a top 21 perpendicular to the tube 20. The dispensing duct 10*d* is formed partly along the axis of the tube 20 and partly along a radius of the top 21. The dispensing duct 10*d* is formed partly along the axis of the tube 20 and partly along a radius of the top 21. The dispensing duct 10*d* permits ejection of the product to be dispensed through a diaphragm 11*d*. The cap 21 has on its lower surface a peripheral ridge 22 which is located in a peripheral recess 23 formed on the upper edge of the radial blade 16*d* of the peripheral member 13*d* of this dispensing cap. At the lower end of the axial tube 20 is a collar 12*d* positioned beneath the lower edges 17*d* of the fins 16*d*. The peripheral member 13*d* is attached to the container 1 in the same manner as the peripheral member 13.

The operation of the dispensing cap according to this embodiment is identical to that which has already been described. In this embodiment, as in the embodiment of FIG. 5, the dispensing member necessarily constitutes a separate piece from the peripheral member of the dispensing cap. In the embodiment of FIG. 6 the dispensing member is forced down into the frusto-conical space defined by the blade 16*d* so as to bring the collar 12*d* beneath the edges 17*d* of the blade 16*d*. Once thus positioned, the dispensing member becomes fixed to the peripheral member 13*d* and the dispensing cap is then mounted on the container 1 as previously indicated.

Figure 7:
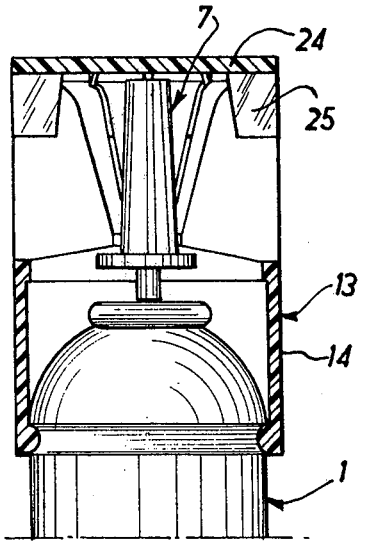
FIG. 7 is an axial sectional view taken through the cap of FIG. 1 equipped with a safety device.
Figure 8:
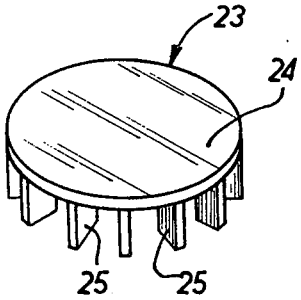
FIG. 8 is a perspective view showing the safety device of FIG. 7.

FIGS. 6 and 7 offer the possibility of mounting on a dispensing cap of the type shown on FIG. 1, a safety device making it possible to prevent an unintentional movement of the dispensing cap during transport or handling. For this purpose a cap 23 consisting of a disc 24 carrying radial vanes 25 is fitted onto the peripheral member 13. The vanes 25 are inserted in the grooves 26 which separate the fins 16 of the peripheral member 13 and the vanes 25 are depressed until the disc 24 abuts the upper surface of the fins 16. This holds all the fins 16 in place and prevents the rotation of a fin with respect to the others and with respect to the cylindrical wall 14 so that dispensing will not take place due to the exertion of pressure on the external surfaces of the fins 16. At the moment of use, it suffices to remove the cap 23 in order to permit the user to operate the dispensing cap according to the invention in the normal way.

Figure 9:
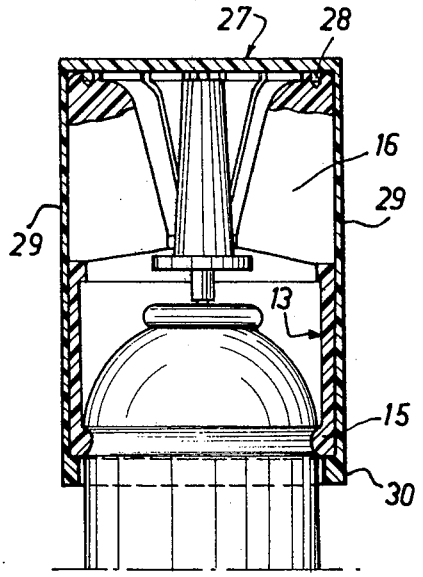
FIG. 9 is an axial sectional view taken through the cap of FIG. 1 equipped with a device for insuring inviolability.
Figure 10:
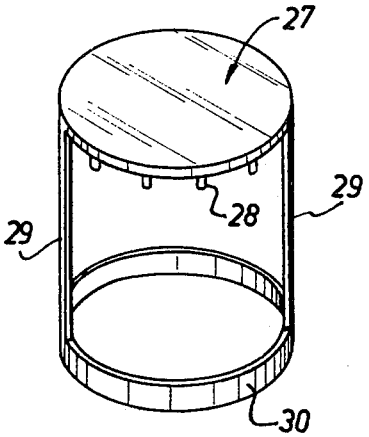
FIG. 10 is a perspective view showing the inviolability device of FIG. 9.

FIGS. 9 and 10 show a device for insuring inviolability which may be used in cooperation with the dispensing cap shown on FIGS. 1 and 2. On the upper surface of the fins 16 is a cap 27 consisting of a disc carrying on its lower surface as many pins 28 as there are fins 16. The pins 28 penetrate seats formed in the upper surfaces of the fins 16 so that the mounting of the cap 27 on the upper surface of the fins 16 as shown in FIG. 9 prevents movement of the fins 16. The disc 27 is held on the upper surface of the fins 16 by two diametrically opposed tabs 29. One of the ends of these tabs 29 is connected to the cap 27 and the other end is connected to a ring of plastic material 30 positioned beneath the ridge 15 of the peripheral member 13 of the dispensing cap. The ring 30 is mounted in the position shown on FIG. 9, while hot, by utilizing the dilation of the plastic material and the cap may be lifted by breaking the tabs 29, or by tearing the ring 30, which may have a weakened point. It will be seen that one may thus insure the inviolability of the pressurized container equipped with a dispensing cap according to the invention.

It will of course be understood that the embodiments which have just been described have been given purely by way of illustration and example, and may be modified as to detail without thereby departing from the basic principles of the invention.

What is claimed is:

1. Dispensing cap adapted to be mounted on a pressurized container provided at its upper end with a dispensing valve having an outlet duct, said cap comprising a peripheral member carrying mounting means at one end for attaching the cap to the pressurized container and at least three fins arranged in a circle at its other end, with each of said fins individually movable in a plane passing substantially through the axis of the cap and the radially outer edges of said fins defining a cylinder and being positioned at least as far from said axis as the cylindrical wall of said container, and said fins defining an internal space opening away from the valve and being elastically hinged to said peripheral member, and a dispensing member actuated by said fins, one end of which is adapted to fit onto said outlet duct and actuate said duct to actuate said valve, at least part of said dispensing member lying in said space within the circle defined by the fins of the peripheral member, said dispensing member comprising an annular zone contacting each of the fins of the peripheral member, whereby radially inward pressure on any one of said fins will actuate said dispensing member and duct and thereby actuate said valve.

2. Cap as claimed in claim 1 in which the fins engage a collar on the dispensing member.

3. Cap as claimed in claim 1 in which the dispensing member is integral with the fins of the peripheral member and the fins act on a zone connecting the fins to the dispensing member.

4. Cap as claimed in claim 1 which is symmetrical about a central axis, the fins of the peripheral member being radial fins separated from each other by substantially radial slots.

5. Cap as claimed in claim 1 in which the peripheral member comprises a cylindrical wall one end of which carries said means for mounting it on the container.

6. Cap as claimed in claim 5 in which the cylindrical wall of the peripheral member has a free end carrying at least one ridge adapted to snap fit into a annular neck in the lateral cylindrical wall of the container and constituting said mounting means.

7. Cap as claimed in claim 5 in which the peripheral member is made of a plastic material and the zone connecting the fins to the cylindrical wall of the peripheral member is thick enough to supply an elastic return force acting on each of the fins.

8. Cap as claimed in claim 1 in which the dispensing member comprises a diaphragm at one end and a spigot at its other end, which spigot is adapted to fit on the outlet tube of the container valve, said diaphragm and spigot being connected by a duct within the dispensing member.

9. Cap as claimed in claim 1 in which the dispensing member is substantially straight.

10. Cap as claimed in claim 1 in which the dispensing member is a right angle elbow.

11. Cap as claimed in claim 10 in which a part of the dispensing member is perpendicular to the axis of the cap and opens externally of the cap beneath the upper ends of the fins, at least one of the fins being shortened to permit the passage of the part of the dispensing member perpendicular to the axis of the cap.

12. Cap as claimed in claim 10 in which a part of the dispensing member which is perpendicular to the axis of the cap opens to the outside of the cap above the upper ends of the fins, said dispensing member comprising an axial part which is adapted to fit onto the outlet tube of the valve and a flat disc perpendicular to said axial part, said flat disc surmounting the vanes of the peripheral member and comprising the part of the internal duct of the dispensing member which is perpendicular to the axis of the cap.

13. Cap as claimed in claim 5 in which the peripheral member has a generally cylindrical external shape, with the outer edges of the fins constituting the generatrices of this cylinder, and being positioned in alignment with a cylindrical wall which carries at its free end means for attaching the cap to the container.

14. Cap as claimed in claim 5 in which the outer edges of the fins of the peripheral member define a substantially spherical volume connected to a cylindrical wall the lower part of which carries the means for attaching the cap to the container.

15. Cap as claimed in claim 1 associated with safety means consisting of a disc above the upper ends of the fins of the peripheral member, said disc comprising as many locking members as the peripheral member comprises fins, which locking members may be pins penetrating into the body of each fin or vanes inserted between each pair of said fins.

16. Cap as claimed in claim 15 in which the safety member is connected to an attaching ring affixed to the cap and/or the container, the connections and/or the attaching ring being frangible.

17. In combination a dispensing cap as claimed in claim 1 mounted on an aerosol container provided with a valve adapted to cooperate with said cap.

* * * * *